US005945154A

United States Patent [19]

Thomas

[11] Patent Number: 5,945,154

[45] Date of Patent: Aug. 31, 1999

[54] METHOD OF MAKING COLD COATED NON-TOXIC TOY

[76] Inventor: James L. Thomas, 2007 Victoria Rd., Mendota Heights, Minn. 55118

[21] Appl. No.: 08/959,802

[22] Filed: Oct. 29, 1997

[51] Int. Cl.[6] ..... B05D 1/00

[52] U.S. Cl. ..... 427/11; 427/242

[58] Field of Search ..... 427/11, 242; 118/76, 118/240, 417, 418; 446/385

[56] References Cited

U.S. PATENT DOCUMENTS

| | | | |
|---|---|---|---|
| 940,593 | 11/1909 | Hardman . | |
| 1,121,644 | 12/1914 | Marr . | |
| 2,111,494 | 3/1938 | Preston, Sr. | 91/70 |
| 3,066,045 | 11/1962 | Lewis | 117/109 |
| 4,454,175 | 6/1984 | Martin | 427/242 |
| 4,781,120 | 11/1988 | Farrow et al. | 104/118 |
| 4,831,959 | 5/1989 | Turner | 118/303 |
| 5,447,584 | 9/1995 | Shakespeare | 156/63 |

OTHER PUBLICATIONS

"Woodturning Traditional Folk Toys", Alan & Gill Bridgewater pp. 18–29, 125–127, Sterling Pub. Co, N.Y., 1994.

*Primary Examiner*—Frederick Parker
*Attorney, Agent, or Firm*—Jacobson & Johnson

[57] ABSTRACT

A method of making a non-toxic toy for a child by cutting a block into the shape of a toy and then placing the toy into a bin of granular paraffin particles followed by tumbling the toy the bin of granular paraffin particles with the granular particles being sufficiently large so as to prevent caking of the particles and sufficiently small so that the paraffin particles can impact on all areas of the toy to produce a paraffin coated toy that is in a ready-to-play with condition when it is removed from the bin of granular paraffin.

7 Claims, 1 Drawing Sheet

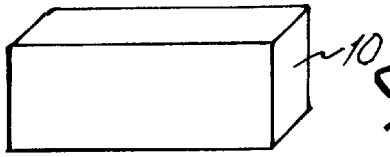
Fig. 1
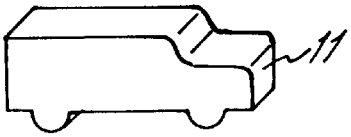
Fig. 2
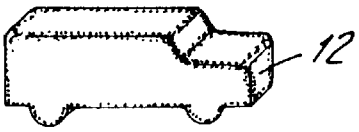
Fig. 3
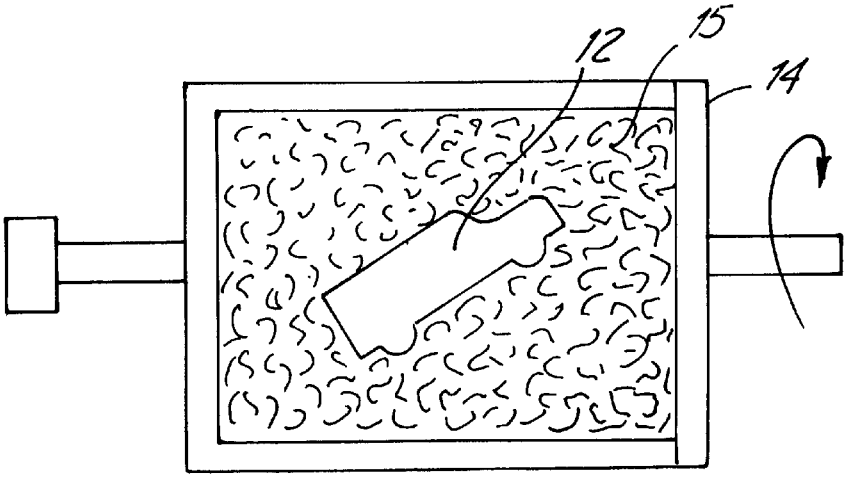
Fig. 4
Fig. 5
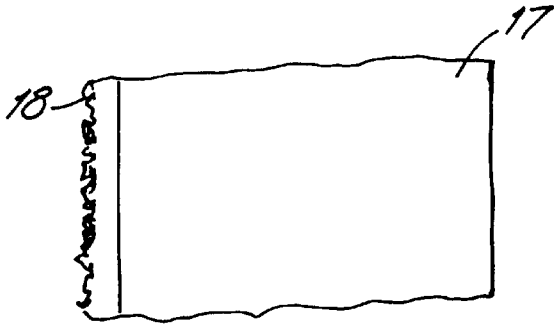

METHOD OF MAKING COLD COATED NON-TOXIC TOY

FIELD OF THE INVENTION

This invention relates generally to toys, more specifically to a cold coating method of applying a non-toxic finish to a toy, particularly to a wood toy, to produce a toy in a ready-to-play with condition.

BACKGROUND OF THE INVENTION

One of difficulties parents have in choosing safe toys for small children is that oftentimes toys which are considered safe are later discovered to have toxic materials in them. Parents look for toys that they can allow their child to enjoy, with confidence that the child will not be harmed by the chemicals used to apply a finish to the toy, as oftentimes children put toys directly into their mouth. Particularly for small children, it is important that the toy not have any small pieces that can be accidentally swallowed by the child. In addition, the toy must appeal to the child. Wooden toys and partially one-piece wooden toys in the shape of trucks or cars often have appeal to small children. If the wooden toys are left unfinished with no protective coating, the wood soon absorbs soil and dirt and becomes unsightly as well as unsanitary. If the toys are finished, the paints and finishes used on toys may contain toxic materials.

The present invention provides a toy with a safe coating of a non-toxic edible material commonly used with foodstuffs. The present invention also provides a method of coating a wooden toy with a non-toxic surface finish while simultaneously providing a smooth clean finish to the toy so that the toy is less susceptible to collecting dirt and bacteria. By using a non-toxic material such as paraffin that has a long history in the use of preserving jellies and jams, one is assured that the coating is non-toxic. Because the paraffin is cold coated on the surface of the toy by impingement of the paraffin particles onto the surfaces of the wood toy, one can provide an in situ protective coating to the wooden toy so that when the toy is removed from a vibrator bin it requires no further finishing. The toy is now in a ready-to-play with condition. In addition, as the toy or the paraffin does not have to be heated to apply the coating, one is ensured that the toy and the paraffin retain their chemical integrity. Thus, the present invention not only provides a safe toy by using non-toxic materials such as paraffin and food coloring, but provides a cold coating process. In addition, the time needed to finish the toy is drastically reduced as the toy can be removed from a vibrator bin in a ready-to-play with condition with the toy having an impinged covering of paraffin that provides a sheen to the surface of the toy and makes the toy less susceptible to having dirt becoming absorbed in the wood.

DESCRIPTION OF THE PRIOR ART

U.S. Pat. No. 1,121,644 discloses a method of treating woods of low specific gravities, such as balsa wood and ceiba, by immersing the wood articles in a liquid bath of paraffin, rosin, a dye and diatomaceous earth at 250° F. to a temperature near the solidifying temperature of the bath. The woods are intended for use in such devices as life belts and life preservers.

U.S. Pat. No. 2,111,494 disclose a process of treating soft woods by applying a dye or stain containing a mild from of an acid followed by heat treatment to dry the surface and soften the grain fats or gums.

U.S. Pat. No. 4,781,120 discloses a train set wherein a smoothing additive such as wax or paraffin is applied over the monorail track to allow the vehicle to slide over the monorail track.

U.S. Pat. No. 3,066,045 discloses a method of providing a decorative coating over a wood product by tumbling a wand product in a revolving barrel containing wood scaling liquid coating while adding wood sealing liquid of greater viscosity in order to cause the coating to stick together and produce an uneven coating.

U.S. Pat. No. 940,593 discloses coating an article with shellac or stain by revolving a barrel containing the articles with a distributor having brushes for applying the shellac or stain to the articles.

U.S. Pat. No. 5,447,584 discloses a method of making non-toxic light weight articles for use in toys, games, and arts and crafts projects with the articles coated with an edible water soluble composition made from a starch base supplemented with polyalkylene glycol or a derivative thereof.

SUMMARY OF THE INVENTION

Briefly, the present invention comprises a non-toxic toy and a cold coating method of making a non-toxic toy for a child by cutting a block of wood into the shape of a toy and then placing the toy into a bin of non-toxic granular particles having a hardness less than the hardness of the block wood, followed by tumbling the toy in the bin of granular particles with the granular particles being sufficiently large so as to prevent caking of the particles, and sufficiently small so that the granular particles can impactedly impinge upon exterior surface area of the toy, causing a portion of the granular particles to adhere thereto to produce a cold coated toy that is in a ready-to-play with condition when it is removed from the bin of granular particles.

BRIEF DESCRIPTION OF THE DRAWINGS

FIG. 1 is a perspective view of a block of wood;

FIG. 2 is a perspective view of a block of wood of FIG. 1 cut into the shape of a toy;

FIG. 3 is a perspective view of a block of wood of FIG. 2 in a sanded condition;

FIG. 4 is a perspective view of a block of wood of FIG. 3 located in a vibrator bin filled with paraffin particles; and FIG. 5 is an enlarged portion of a toy that has been tumbled in the paraffin revealing a coating of paraffin on the outside of the toy.

DESCRIPTION OF THE PREFERRED EMBODIMENT

In the method of making a non-toxic toy for a child, one first selects a suitable hard wood such as birch or maple. While other woods could be used, hard woods are preferred as they provide a heft and durability by resisting impacts to the surface of the wood. In the preferred method, one cuts the toy from a single piece of wood to ensure that there will not be any adhesives with toxic materials in the toy. In addition, one is assured that there will not be any small pieces that a child can swallow. While wood is the preferred material, it is envisioned that other materials could be used to make a toy if the materials were non-toxic and were able to receive and hold a cold coating of a non-toxic material.

After selecting the wood, one cuts the piece of non-toxic hard wood in the shape of a toy such as a truck, car or the like with the toy having multiple surfaces thereon. The toy then has a three dimensional shape which a child can readily recognize. Preferably, the toy is sufficiently small so that a child can grasp the toy in one hand but sufficiently large so that the child cannot accidentally swallow the toy.

After cutting the wood block into the desired shape (such as a truck) one sands the surfaces of the toy to obtain a smooth finish free of slivers and sharp comers. This step provides a toy that can handled and played with by a child with chances of injury due to slivers and sharp corners minimized.

If a person wants to color the toy, they can selectively paint the surfaces of the toy with a non-toxic food coloring to provide color to the surfaces of the toy. Food colorings are used as they are inherently non-toxic, and they can provide color to the surface of the wood toy by being applied directly onto the wooden toy. Although the surface of the toy can be selectively covered with a non-toxic food coloring, oftentimes, one may want to leave the toy with a natural wood color by not applying a food color to the toy.

To begin the process of cold coating the surfaces of the toy with a protective coating of a non-toxic material such as paraffin, one places the toy into a bin of granular particles such as granular paraffin particles. While paraffin is an ideal non-toxic material, the non-toxic granular material selected for the cold coating should have a hardness less than the hardness of the toy so that when the granular particles impact on the exterior surface of the toy the granular particles, or at least a portion of them, partially adhere to the surface of the toy thereby leaving a coating of paraffin on the toy. In addition, the granular particles should be sufficiently large so as to prevent caking of the particles and sufficiently small so that the granular particles can impact on all areas of the wooden toy. If paraffin is used, it has been found that if the granular particles are larger than sugar particles but less than ⅛ of an inch the process works well. If the particles are too small the granular particles will cake and adhere unevenly to the surface of the toy. If the particles are too large the granular particles will not flow over the toy and get into all the surface areas on the toy, leaving one with an uneven coating on the toy.

Next, one tumbles the toy in a vibrator bin of granular paraffin particles with both the granular particles and the toy at about room temperature of 70° F. for about four hours. The length of time to tumble the toy varies with the thickness of the paraffin coating desired on the toy. The longer the tumbling, the thicker the coating. In addition, if one wants to impregnate the paraffin into the pores of the wood one can place small hard glass balls into the paraffin. The small hard glass beads impinge on the paraffin covered surfaces and force the paraffin into the pores of the wood. The glass beads should be sufficiently small so as to be able to penetrate into any crevices on the toy. Glass beads are preferred as the paraffin does not adhere to the glass beads allowing the glass beads to provide a miniature hammering action to drive the paraffin into the pores of the wood.

The present invention is usable with commercially available paraffin or paraffin containing materials which are non toxic. The commercially available refined paraffin melts at a temperature of about 144° F. and is available from Dussek Campbell of 3650 Touhy Ave, Skojie, Ill. In addition to the refined paraffin, a paraffin containing material can be used with my invention. A suitable material is, polyethylene wax which is somewhat harder then the refined paraffin and melts at 225° F. The polyethylene wax, which contains paraffin is also commercially available from Dussek Campbell. Either or both of the paraffin containing materials are usable with the present invention or a combination of both paraffin material can be used in the cold coating process of the present invention. An advantage of the use of the harder paraffin is that it the paraffin can be driven further into the pores of the wood through only the action of the paraffin.

After tumbling the toy for a sufficiently long time, one removes the toy from the tumbler with the toy in a ready-to-play with condition.

In order to illustrate the steps in the invention, reference should be made to FIG. 1 which shows a rectangular block of hard wood 10 in a condition to be cut into the shape of a toy.

FIG. 2 shows the wood block cut into the shape of a toy truck 11. The truck has a size of about four to five inches in length and can be easily grasped by a child.

FIG. 3 shows the wood toy 12 formed from block 10 with the sharp corners sanded down. The wood toy 12 is now in a condition for applying a finish to the surface of the toy. The finish can be applied by painting a food coloring onto the surface of the toy or by dipping the toy in a food coloring. If a color is not desired, one can finish the toy with a coating of a non-toxic material.

FIG. 4 shows a vibrator tumbler 14 with wood toy 12 located in a bed of granular material 15. The granular material comprises particles of paraffin at room temperature with the particles of paraffin having a size sufficiently large so as not to cake on the surfaces of the toy but sufficiently small so that the particles will flow into small areas of the toy and provide a coating on the toy.

FIG. 5 illustrates an enlarged portion of toy 17 with a layer of paraffin 18 located on the surface of the toy. The result is a surface that does not absorb dirt and provides a smooth feel that a child likes to touch. Also, as the wood is coated with a non-toxic material, a parent does not need to be concerned that the child will get sick or have an allergic reaction to a toxic coating on the article.

I claim:

1. The method of making a non-toxic toy for a child comprising the steps of:

cutting a piece of non-toxic hard wood in the shape of a toy with the toy having multiple surfaces thereon;

sanding the surfaces of the toy to obtain a smooth finish free of slivers and sharp corners;

selectively painting the sanded surfaces of the toy with a non-toxic food coloring to provide color to the sanded surfaces of the toy;

placing the painted toy into a bin of granular paraffin particles with the toy having a size larger than the granular paraffin particles;

tumbling the painted toy in the bin of granular paraffin particles with the granular paraffin particles being sufficiently large so as to prevent caking of the particles to one another and sufficiently small so that the granular paraffin particles can impact on all areas of the wooden toy; and continuing tumbling the bin of granular paraffin with the toy therein for sufficiently long period of time until the surfaces of the toy are covered with a coating of paraffin.

2. The method of claim 1 wherein the paraffin is tumbled at room temperature of about 70° F.

3. The method of claim 2 wherein the paraffin is softer than the wood.

4. The method of claim 3 wherein the wood is selected from the group consisting of maple and birch.

5. The method of claim 4 including placing balls into the bin so that the balls tumbling with the paraffin particles and toy impregnate the paraffin into the pores of the wood.

6. The method of claim 1 wherein a portion of the paraffin particles contain polyethylene wax.

7. The cold coating method of making a ray-to-play with non-toxic toy for a child comprising the steps of:

placing a toy into a bin of granular non-toxic solid particles characterized by being smaller than the toy and having a hardness less than the hardness of a toy to be coated, said granular non-toxic solid particles sufficiently large so as to prevent caking of the granular non-toxic solid particles and sufficiently small so that the granular non-toxic solid particles can impinge on all surfaces of the toy;

vibrating the bin of granular non-toxic solid particles containing the granular non-toxic solid particles and the toy with sufficient force so as to cause the non-toxic granular particles to impactidly impinge on the surfaces to cause a portion of the non-toxic granular solid particles to adhere to the surface of the toy; and continuing the vibrating of the bin of non-toxic granular solid particles with the toy therein for sufficiently long period of time until the surfaces of the toy are impingedly covered with a coating formed of granular non-toxic solid particles.

* * * * *